United States Patent [19]

Grabovac

[11] 3,939,924

[45] Feb. 24, 1976

[54] POWER TORQUE WRENCH

[75] Inventor: Bosko Grabovac, Mission Viejo, Calif.

[73] Assignee: Consolidated Devices, Inc., South El Monte, Calif.

[22] Filed: Nov. 29, 1974

[21] Appl. No.: 528,409

[52] U.S. Cl. ..... 173/163; 81/57.11; 81/52.4 R

[51] Int. Cl.[2] ..... B25B 21/00

[58] Field of Search ..... 173/163; 81/57.11, 57.13, 81/57.14, 52.4 R, 52.4, 52.5; 192/.034

[56] References Cited

UNITED STATES PATENTS

| | | | |
|---|---|---|---|
| 2,740,507 | 4/1956 | Shaff | 81/57.11 |
| 2,740,508 | 4/1956 | Shaff | 81/57.11 |
| 2,808,749 | 10/1957 | Lampke | 81/57.13 |
| 3,733,935 | 5/1973 | Tsuji | 173/163 |

*Primary Examiner*—Frank L. Abbott
*Assistant Examiner*—William F. Pate, III
*Attorney, Agent, or Firm*—Georges A. Maxwell

[57] ABSTRACT

A torque wrench adapted to applying predetermined maximum torque onto related work comprising an elongate lever arm, a work engaging ratchet head including a body coupled to one end of the arm and adapted to be rotated by the arm, a spindle with a work engaging projection rotatable in the body and ratchet means between the spindle and body to establish driving engagement therebetween when the body is rotated in one direction by the arm, a manually controlled prime mover carried by the wrench in substantially fixed position relative to the body and transmission means between the prime mover and the spindle, said prime mover and transmission operable to selectively rotate the spindle in said one direction and in overriding relationship to the ratchet means, the torque deiivered to the spindle by the prime mover being less than the predetermined maximum torque to be applied by the wrench on to related work.

8 Claims, 12 Drawing Figures

POWER TORQUE WRENCH

This invention has to do with a power torque wrench and is more particularly concerned with a torque wrench for applying limited or controlled torque onto elements of screw fastening means and incorporating power drive means for advancing said elements preparatory to applying said limited or controlled torque.

In the hand tool art there are numerous instances where the torque applied to screw fasteners and the like must be accurately controlled. To this end, the art has provided that class of tool broadly classified as torque wrenches. Torque wrenches are provided in several basic types; first there is the release type of wrench which is such that driving engagement is interrupted between or from tool to fastener when predetermined torque is applied to a related fastener; second, there is the click-type of wrench which is such that when predetermined torque is applied to a related fastener, the wrench transmits an audible signal; and third, there is the dial type of wrench which includes a dial which indicates the torsional force applied onto a related fastener.

Each of the above noted types of wrenches is provided in a number of different forms; some with special or unusual features and others which combine certain attributes and features of the several types of wrenches.

All such wrenches include, basically, an elongate lever arm with a hand engaging rear end portion and a work engaging head at the other or front end of the arm. The work engaging head is generally characterized by a body portion, fixed or pivotally engaged or connected with the front end of the arm and has a polygonal drive member to engage in polygonal openings in related fastener engaging drive sockets and the like and/or a polygonal drive opening in which a polygonal end portion of a fastener engaging drive tool or the like is to be engaged. The polygonal drive members and/or drive openings in the heads are at right angle to the central longitudinal axes of the arms.

In accordance with common practice, in carrying forward of the instant invention, the work engaging heads are provided or include ratchet means within the bodies thereof or between the bodies and those parts which define the drive members and/or drive openings. The ratchet means permit or allow the drive members and/or openings in the heads to be intermittently advanced in one rotative direction, a fraction of one revolution thereof by manually moving the rear ends of the arms, back and forth, through an arc corresponding generally to each intermittent advancement of the drive members and/or openings. As a general rule, the ratchet means are provided with means to reverse the direction of drive afforded thereby.

The above noted ratchet type of work engaging heads is notoriously well known, in full detail, to those familiar with the art to which the instant invention pertains and require no specific illustration or further detailed description. Accordingly, in the following, when reference is made to a work engaging head, it is to be understood that the referred to head is a reversible ratchet type head, of ordinary, common form and construction, unless otherwise specified.

It can be presently noted and it will become apparent from the following that the details of the internal construction and operation of the torque wrenches, that is, the torque or force responsive means provided in the wrenches, can vary widely in construction and/or operation without in any way affecting the operation and novelty of the instant invention. Accordingly, except to the extent required to adequately disclose and explain the instant invention, the details of construction and operation of the torque wrenches employed in carrying out this invention will hereinafter be kept to a minimum and considered in a general manner to that extent possible.

In the course of advancing fasteners into or with related work and parts it is common and frequent that the fasteners, be they threaded male or female parts must be rotatably advanced a plurality of many turns before they are seated and in that position where final torqueing and setting of thereof can be effected. Advancing of the fasteners to a seated position generally requires little applied force, but requires considerably motion or movement. When once advanced to a seated condition, advancing the fasteners to a tight, torqued or set condition, generally requires considerable applied force and very little motion or movement. For example, to advance a fastener to seated condition may require turning it fifteen or more revolutions and to torque and set that fastener, once seated, frequently requires that the fastener be turned or further advanced, no more than 15° to 30°.

In the industrial arts, it is common practice to employ electric, hydraulic or pneumatic fastener advancing hand tool to rapidly advance fasteners to a seated condition, preparatory to applying setting torque thereto, by means of torque wrenches. This practice requires the provision of the noted advancing tools and the torque wrenches and requires that the mechanic or tradesman expend considerable time and effort handling and switching from one tool to the other in the course of performing the required work. Further, it is not infrequent that the power operated advancing tools employed are not such that the torque applied thereby can be effectively controlled, with the result that in the course of advancing fasteners to a seated condition thereby, excess torque is applied thereto when the required seated condition is reached. When this condition occurs, the fastener must first be unset or loosened and then tightened or reset by the second to be used torque wrench.

It is an object and feature of the present invention to provide a combination power operated fastener advancing and torque wrench tool whereby screw fasteners can be easily and effectively advanced to seated condition by power drive means, without special manual movement of the tool and can thereupon be torqued and set by limited manual movement of the tool. Accordingly, it is an object and feature of this invention to provide a single tool of the character referred to which effectively takes the place of separate power operated advancing tools and torque wrenches and thereby greatly simplifies the manual efforts and materially shortens the time commonly expended in the application, advancing and torque setting of screw fasteners.

It is an object and feature of the instant invention to provide a new tool of the character referred to wherein the power operated fastener advancing means is such that it applies less torsional forces onto the fasteners worked upon than the torsional setting forces to be applied thereto by the tool subsequent to the fasteners being seated or fully advanced, but not set.

It is yet another object and feature of my invention to provide a tool of the character referred to wherein various forms and of commercially available fasteners advancing tools, or parts thereof, and torque wrenches can be effectively combined and/or cooperatively related with each other to provide an effective, convenient and easy to use fastener advancing to torque setting tool.

The foregoing and other objects and features of my invention will be fully understood from the following detailed description of typical preferred forms and applications of the invention, throughout which description reference is made to the accompanying drawings, in which.

Figures 1, 2, 3, 4, 5, 6, 7:
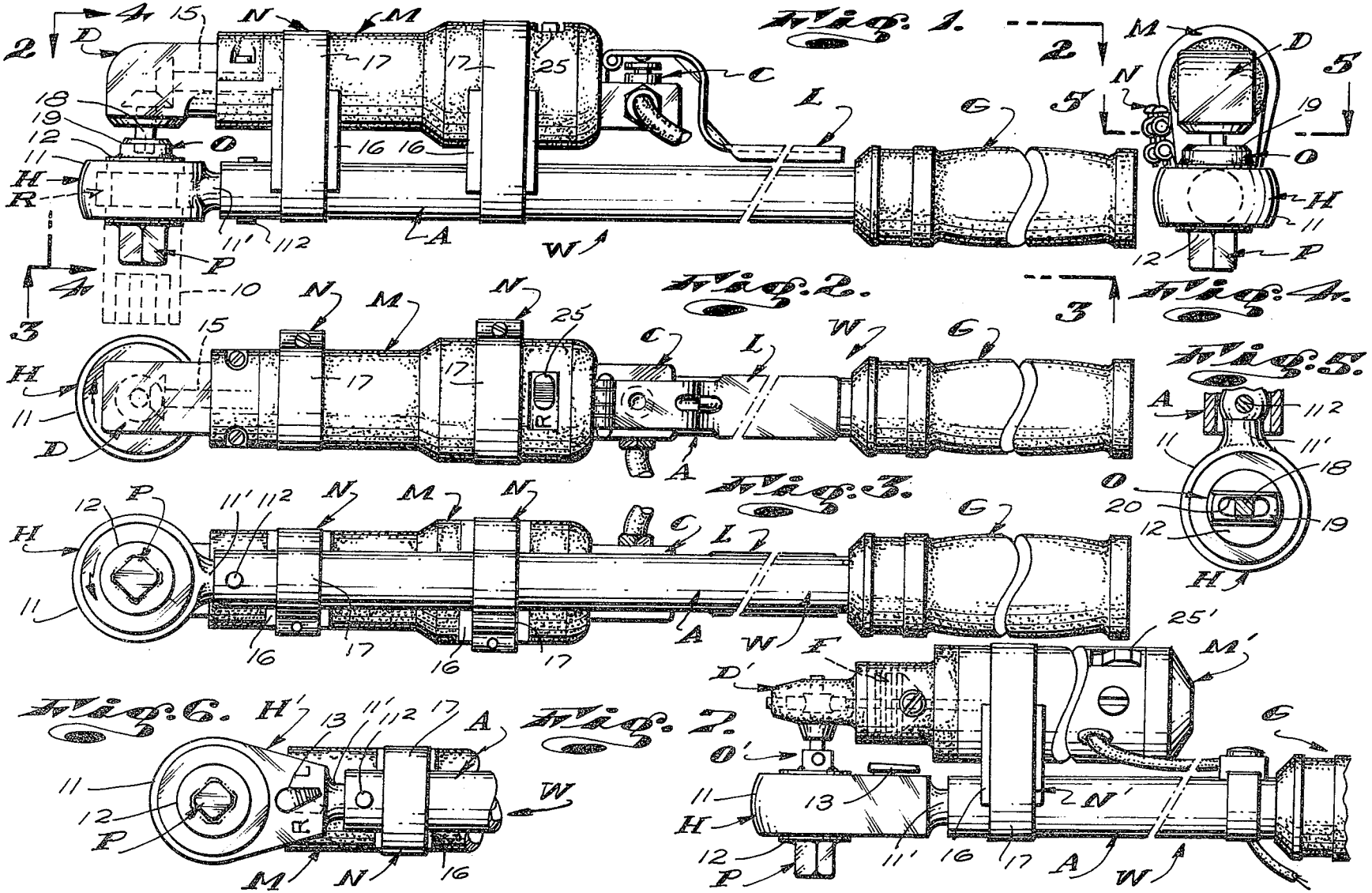
FIG. 1 is a side elevation view of a wrench embodying the present invention.
FIG. 2 is a top view taken as indicated by line 2—2 on FIG. 1.
FIG. 3 is a bottom view taken as indicated by line 3—3 on FIG. 1.
FIG. 4 is an end view taken as indicated by line 4—4 on FIG. 1.
FIG. 5 is a sectional view taken as indicated by line 5—5 on FIG. 4.
FIG. 6 is a view similar to a portion of FIG. 3 showing another form of ratchet head.
FIG. 7 is a view similar to FIG. 1 showing another embodiment of the invention.

Referring to FIGS. 1 through of the drawings, I have shown the present invention embodying or including a conventional torque wrench W. The wrench W can be a torque releasing type of torque wrench such as is disclosed in the French patent of M. Gustave Tourand, French Pat. No. 965,788, issued Oct. 6, 1950, or can be and preferably is a click type torque wrench such as is disclosed in U.S. Pat. No. 3,772,942, of Bosko Grabovac for "Adjustable Torque Wrench", issued Nov. 20, 1973.

The wrench W includes an elongate tubular lever arm A with front and rear ends, a work engaging head H at the front end of the arm and a hand grip G are the rear end of the arm. The work engaging head H is characterized by an elongate polygonal tool or work engaging projection or drive member P on an axis normal to the longitudinal axis of the arm and projecting radially or, as shown, downwardly at the forward end of the wrench. The projection P is, for example, adopted to engage a desired drive socket 10, (as shown in phantom lines in FIG. 1 of the drawings) in accordance with well known and established practices. The work engaging head H in the form of the invention now under consideration, is a conventional ratchet head and includes a body 11 secured with or to the front end of the arm A. The body 11 rotatably carries a central, vertical spindle 12 on which the projection P is formed and from which the projection depends, as shown.

The manner in which the ratchet head body 11 is fixed or secured to the arm depends upon the type of wrench employed. For example, if the wrench is a torque release type wrench, such as referred to above, the body 11 is rigidly fixed to and may be formed integral with the front end of the arm A, whereas, if the wrench is a click type wrench, the body 11 is pivotally connected with the front end of the arm by means of a rearwardly projecting moment arm 11' on the body entering the front end of the arm and a pivot pin $\mathbf{11^2}$ engaged through and between the arms A and 11'. In the case of dial type torque wrenches, the ratchet head is most commonly fixedly carried by the forward end of a deflection beam within the arm A (or an arm like body) and project freely from the front end thereof.

In the case of torque release type wrenches, the ratchet heads are most commonly provided with variably or adjustable, yieldingly releasable racket or clutch means between their bodies and spindles whereby driving engagement between the bodies and spindles is broken or is released upon the exertion of predetermined torsional forces therebetween. Further, the heads of such wrenches are or can be provided with secondary racket or clutch means which enable the spindles to be substantially freely rotated relative to the bodies and the arm, counter to the direction of movement of the arm for applied torque.

Since the structure and means provided in the above noted torque release wrenches to effect their operation can vary widely in form and details without affecting the instant invention, present detailed illustrations of such means and/or structure would serve no useful end, would only tend to unduly burden this disclosure, In the case of click-type and dial-type wrenches, the ratchet heads are of a conventional form and nature, including suitable ratchet means R, (indicated diagrammatically in dotted lines) between their bodies and spindles and can be uni-directional, or bi-directional. In FIGS. 1 through 4 of the drawings, I have shown the wrench W provided with or including a ratchet head H of one common configuration which might be uni-directional or bi-directional (reversible), while in FIGS. 5 through FIG. 9, I have shown the wrenches provided with or including ratchet head H', the configuration of which is typically that of reversible or bi-directional ratchet heads and which are provided with control levers 13, operable to select the direction of drive.

Summarizing the foregoing, in practice of and in carrying out this invention, substantially any torque wrench structure having an elongate lever arm with front and rear ends and a ratchet head comprising a body, a rotatable spindle and a drive member on the spindle, related to or at the front end of the arm, can be employed.

Referring once again to the wrench W illustrated in FIGS. 1 through 4 of the drawings, the wrench includes generally a prime mover or motor M fixed to the arm A and drive or transmission means D between motor M and the spindle 12 of the wrench ratchet head H and operable to rotate the spindle 12 in the direction of applied torque and/or in overriding drive relationship to the direction of rotation of the arm A for applied torque.

The motor M is shown as an elongate pneumatic motor arranged in vertically spaced parallel relationship with the front portion of the arm and has a forwardly projecting output shaft 15 and a manually operable on and off control valve C at its rear end.

The motor M is releasably fixed to the arm A by suitable mounting means N which means is shown as including longitudinally spaced saddle blocks 16 engageable with and between the motor and the lever arm and clamp bands 17 related to and engaged about the motor, arm and blocks, substantially as illustrated.

The transmission means D is shown as a simple right-angle bevel gear drive unit carried by the front end of the motor M to overlay the spindle 12 of the head H in vertical spaced relationship and having a vertical depending output shaft 18 in axial alignment with the spindle. The output shaft 18 is connected with the spindle 12 by a coupling means O which means is shown as including a polygonal extension or end portion on the shaft 18 and a receiver member 19 fixed to the top or upper end of the spindle and cooperatively receiving the polygonal portion of the shaft to establish driving engagement therebetween. The receiver member 19 is a disc-like part fixed to the top of the spindle as by welding and has a slot 20 in which the shaft 18 is slidably engaged and which extends horizontally and transverse the longitudinal axis of the wrench in an arc concentric with the pivotal axis of the head H. That is, the center of which is coincidental with the pivot pin $11^2$ of the wrench. The means O is such that rotary driving connection is established between the transmission D and the head spindle 12 and, at the same time, the head is free to pivot relative to the arm A and the transmission D, when the wrench is employed to apply setting torque to a related piece of work. It is to be noted that the head H is deflected laterally or swings a very short or limited distance relative to the arm A when the wrench applies setting torque to the work and that the slot 20 need be of corresponding limited longitudinal extent.

In practice, the motor M is spaced a substantial distance forward from the hand grip G of the wrench and a manually engageable operating lever or extension L is provided for the control valve C, which lever extends rearwardly into convenient hand or finger engaging position adjacent the forward end of the handle, as shown.

In practice, the lever L illustrated and described above can be replaced by flexible cable means or, if desired, the valve per se could be detached from the motor, fixed to the arm adjacent the handle and suitably connected with the motor by an air line, without departing from the spirit of the invention.

In use or operation, the torque delivered by the motor is less than the setting torque to be applied by the wrench W. In the case of pneumatic or hydraulic motors, the torque delivered by the motor can be adjusted and set by controlling the fluid or air supply to the motor. This is most commonly effected by means of a pressure regulator (not shown) in the supply line to the motor.

In practice, the motor M can be reversible and such that when the ratchet head H is reversible, as shown in FIG. 6 of the drawing, the tool can be effectively employed to advance both right and left hand fasteners and the like into engagement with related work and/or can be employed to advance and retract such fasteners from the work. To the above end, FIGS. 1 and 2 of the drawings show the motor M provided with a manually operable reversing member or button 25.

In FIG. 7 of the drawings, the motor M′ is shown as a reversible electric motor with a reversing switch 25′ and is under control of a pressure actuated on and off switch C′ fixed to the arm A of the wrench, adjacent the hand grip G. The transmission D′ is shown as a right angle, worm and pinion gear unit and is shown connected with the output shaft 15′ of the motor by means of an adjustable clutch means F. The motor M′ is secured to the arm A by block and band type mounting means N′ similar to the means N described above. The transmission D and spindle 12 of the head H′ are connected by coupling means O′ similar to the means O in the first described embodiment of the invention.

Figures 8, 9, 10, 11, 12:
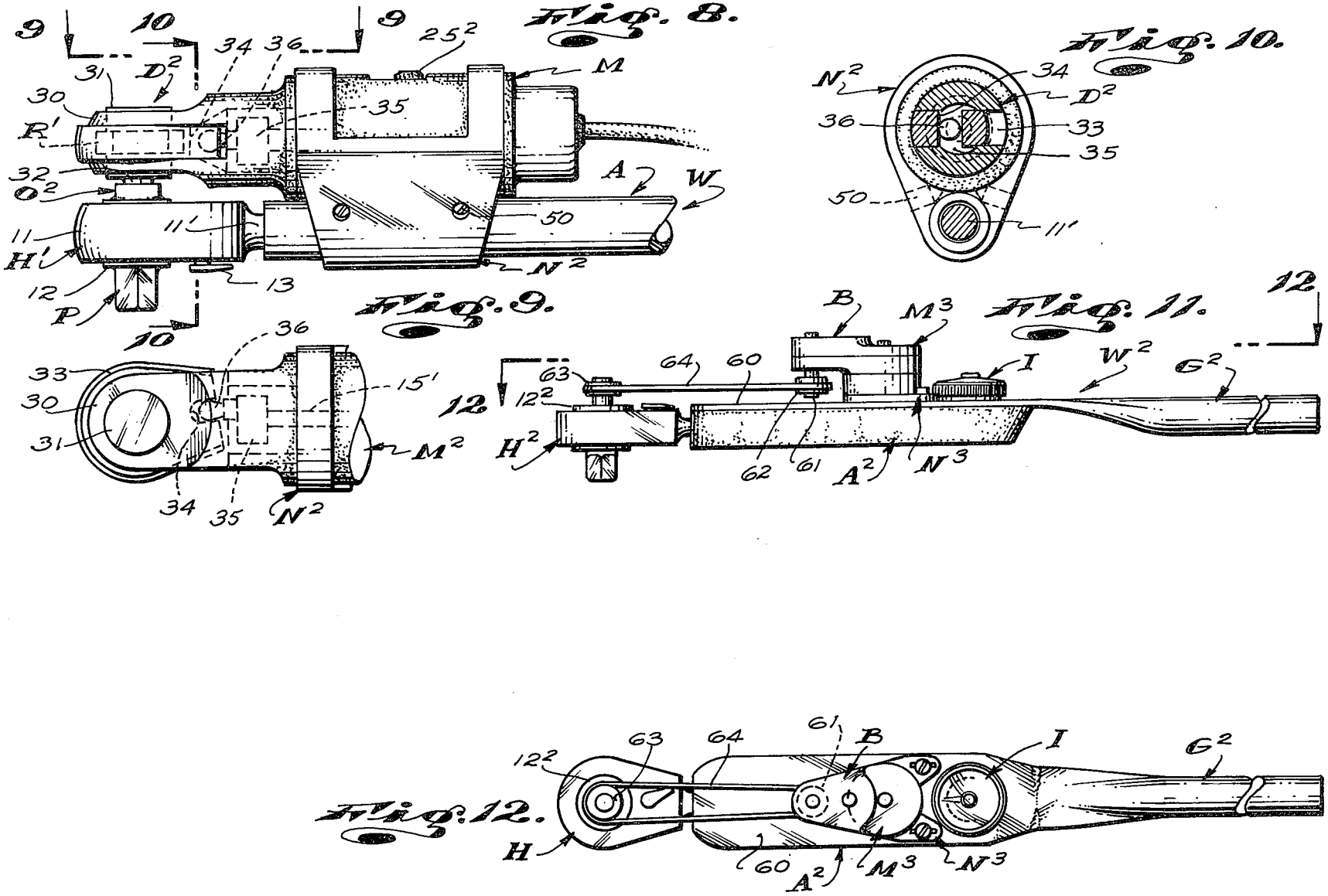
FIG. 8 is a view similar to FIG. 7 showing yet another embodiment of the invention.
FIG. 9 is a view taken as indicated by line 9—9 on FIG. 8.
FIG. 10 is a view taken as indicated by line 10—10 on FIG. 8.
FIG. 11 is a view similar to FIG. 7 showing another embodiment of the invention.
FIG. 12 is a view taken as indicated by line 12—12 on FIG. 11.

In FIGS. 8, 9 and 10 of the drawings, I have shown another form of the invention wherein the transmission $D^2$ is that form or type of transmission commonly referred to as a drive ratchet and consists of a body 30 with a forward portion rotatably carrying a drive spindle 31 with a depending drive shaft 32. The body 30 pivotally carries a horizontal drive arm 33 which is drivingly connected with the spindle by a suitable ratchet means R′ and which projects rearwardly into the rear portion of the body 30. The arm 33 has a vertical and rearwardly opening slot 34. A drive plate 35 is rotatably supported in the body rearward of the arm 33 and has a forwardly projecting drive pin 36 projecting into the slot 34 to establish sliding driving engagement therein and which is radially offset from the rotative axis of the plate 35.

The rear end of the body 30 is mounted in fixed position. For example, and as shown, it is connected to the forward end of the motor $M^2$. The drive plate 35 is suitably connected with the output shaft 15′ of the motor. It will be apparent that when the drive plate is rotated by the motor, the eccentric drive pin 36 in the slot 34 drives the arm 33 laterally, back and forth, and that by virtue of action of the ratchet means R′, the spindle 31 is intermittently turned or rotated, as desired.

The motor $M^2$ can be reversible electric, pneumatic or hydraulic motor, as desired, or as circumstances require, and is secured to the forward portion of the arm A of the wrench by mounting means $N^2$.

The mounting means $N^2$ is shown as including a casting with parallel openings to slidably receive the motor $M^2$ and the arm A and as being provided with jam or interfering lock screws 50 to secure components together.

The output shaft 32 of the means $D^2$ can be coupled with the ratchet head $H^2$ of the wrench by coupling means $O^2$ similar to the means O described in the preceding.

In FIGS. 11 and 12 of the drawings, I have shown (in elevation) one side and the top of a typical dial torque wrench structure $W^2$. The wrench W′ is characterized by an elongate, box-like lever arm $A^2$ with a handle $G^2$ projecting from its rear end and a ratchet head $H^2$ is similar to either of the heads H in the preceding forms of the invention.

The arm has an elongate flat top surface 60 on the rear end portion of which is mounted a suitable indicator dial I.

The details of construction and operation of the wrench $W^2$ is disclosed in U.S. Pat. No. 3,726,134 entitled "DIAL TORQUE WRENCH" issued to Bosko Grabovac on Apr. 10, 1973.

In the form of the invention now under consideration, a drive motor $M^3$ is mounted to the top surface 60 of the arm $A^2$, forward of the dial I by longitudinally adjustable mounting means $N^3$. The motor is preferably a reversible electric motor under control of a manually operable switch (not shown) and is provided with a reduction gear box B with a vertical output shaft 61. The shaft 61 carries a drive pully or wheel 62. The spindle $12^2$ of the ratchet head $H^2$ carries a drive pully wheel 63, substantially as shown, and an endless, looped, helically wound, resilient drive spring 64 is engaged about and between the wheels 62 and 63.

It will be apparent that when the wheel 62 is rotated by the motor $M^3$, the spindle $12^2$ of the head $H^2$ is effectively rotated. It will be further apparent by adjusting the position of the motor $M^3$, longitudinally of the arm $A^2$, by means of the mounting means $N^3$ illustrated, the tension of the drive spring 63 is varied and the torque applied to the spindle $12^2$ can be effectively adjusted so as not to exceed the desired setting torque to be applied by the wrench.

In practice, the pully wheel and drive spring means described above could be substituted by suitable chain and sprockets without departing from the spirit of this invention.

It is to be noted that with the last noted drive means the head of the wrench is free to be deflected laterally and the coupling means O, such as is provided in the previous forms of the invention, is not required or is substituted by the novel relationship of the pulley wheels and drive spring. Since the distance between the pulley wheels is greater than the distance between the axis of the head and the pivotal axes about which the head moves when it is deflected, upon deflection of the head, the tension of the drive spring is relieved slightly. Accordingly, the subject drive means or the spring, which is a coupling means, affords for free lateral deflection of the head, as does the afore-described coupling means O.

With the tool or tools provided by the present invention, the work engaging projections of the ratchet heads are engaged with or otherwise suitably coupled to threaded parts, such as bolts, which have been partially engaged in or with complimentary threaded work elements. The motors of the tools are then energized to rapidly advance the parts into non-set, untorqued, seated engagement with the elements, without notable manual effort. When the parts are thus seated, the motors are turned off and manual force is directionally applied to the rear ends of the lever arms to apply desired, predetermined setting torque onto and through the parts. In practice, though the parts may be turned 15 to 30 more revolutions in the course of being seated and torque set, the lever arm may need to be manually turned no more than 15° to 30°. Further, the time required to advance and set the part may often be reduced from several minutes to as little as 10 or 15 seconds.

Having described my invention, I claim:

1. A torque wrench comprising an elongate lever arm with front and rear ends, a hand grip at the rear end of the arm, a ratchet head pivotally connected with and projecting forward from the front end of the arm and selectively pivotally shiftable laterally relative thereto, said head including a body, a spindle rotatably carried by the body on an axis parallel to the pivotal axis of the head and normal to the longitudinal axis of the arm, ratchet means between the body and spindle establishing driving engagement therebetween upon rotation of the arm and body in a predetermined direction about the axis of the spindle and a work engaging projection in axial alignment with and projecting from the spindle and laterally relative to the axis of the arm, said wrench including means in and related to the arm and the head responsive to the torsional forces at said projection resolved from manually applied forces on the hand grip, whereby said torsional forces applied by the wrench can be controlled and result in lateral pivotal shifting of the head relative to the arm, a drive motor fixedly carried by the arm remote from the spindle, a transmission connected with and between the motor and the spindle and manually operable control means for the motor to selectively set the motor in operation, said motor and transmission operable to selectively rotate the spindle and projection relative to the body in the direction of driving rotation afforded by said ratchet means whereby the spindle and projection are drivingly rotated without rotation of said arm, said transmission including means to afford pivotal lateral shifting of the head relative to the motor and the arm.

2. A torque wrench as set forth in claim 1 wherein said ratchet means and said motor are reversible.

3. A torque wrench as set forth in claim 1 wherein the torsional force exerted onto and through the spindle and projection by the motor and transmission is less than the torsional force to be exerted onto and through the spindle by manually applied force on the arm.

4. A torque wrench as set forth in claim 1 wherein the torsional force exerted onto and through the spindle and projection by the motor and transmission is less than the torsional force to be exerted onto and through the spindle by manually applied force on the arm, said ratchet means and said motor are reversible.

5. A torque wrench as set forth in claim 1 wherein said motor has a forwardly projecting drive shaft, said transmission including a gear box accommodating the drive shaft for free rotation, an output shaft normally aligned with the axis of the spindle, and coupling means between the output shaft and spindle to afford lateral shifting of the head and axial misalignment of the output shaft and spindle, said gear box being spaced from the head opposite from the side thereof from which the projection projects.

6. A torque wrench as set forth in claim 5 wherein the gear box includes bevel gears to transmit motion and force delivered by the drive shaft to the output shaft.

7. A torque wrench as set forth in claim 5 wherein the gear box includes worm and pinion gears to transmit motion of forces delivered by the drive shaft to the output shaft.

8. A torque wrench as set forth in claim 1 wherein said motor carried by the arm and said transmission includes a driven wheel secured to the spindle at the side of the head opposite from which the projection projects and in axial alignment with the spindle, a drive wheel spaced rearward from the drive wheel a greater distance then the distance between the spindle axis and pivotal axis of the head and driven by said motor, and coupling means comprising an elongate endless flexible drive member engaged about and between said wheels.

* * * * *